United States Patent [19]

Friebel et al.

[11] Patent Number: 4,470,783

[45] Date of Patent: Sep. 11, 1984

[54] APPARATUS FOR SCREEDING AND LEVELING

[76] Inventors: Albert Friebel, Wakefieldstrasse 12, D-4620 Castrop-Rauxel; Ferdinand Schneider, Frebergstrasse 2, 4620 Castrop-Rauxel, both of Fed. Rep. of Germany

[21] Appl. No.: 378,828

[22] Filed: May 17, 1982

[30] Foreign Application Priority Data

May 21, 1981 [DE] Fed. Rep. of Germany ..... 3120226

[51] Int. Cl.[3] ..... E01C 19/22

[52] U.S. Cl. ..... 425/62; 404/85; 404/118; 404/120; 425/456

[58] Field of Search ..... 425/456, 62; 404/85, 404/118, 120

[56] References Cited

U.S. PATENT DOCUMENTS

| | | | |
|---|---|---|---|
| 3,210,710 | 10/1965 | Amos | 404/118 X |
| 3,564,986 | 2/1971 | Burgin | 404/118 X |
| 3,883,259 | 5/1975 | Berg et al. | 404/118 X |
| 3,901,616 | 8/1975 | Greening | 404/85 X |
| 3,992,124 | 11/1976 | Schrader | 404/118 |
| 4,261,694 | 4/1981 | Morrison | 425/456 |
| 4,335,976 | 6/1982 | Morrison | 425/456 X |
| 4,371,330 | 2/1983 | Heffernan | 404/118 X |
| 4,379,683 | 4/1983 | Rodgers et al. | 425/456 X |

FOREIGN PATENT DOCUMENTS

| | | | |
|---|---|---|---|
| 1241862 | 6/1967 | Fed. Rep. of Germany | 404/118 |

OTHER PUBLICATIONS

Bulletin 879-B, "Tamping Leveling Finisher", Barber--Greene Company, Aurora, Ill., 1958.

*Primary Examiner*—Donald E. Czaja
*Assistant Examiner*—James C. Housel
*Attorney, Agent, or Firm*—Holman & Stern

[57] ABSTRACT

An apparatus for screeding and leveling coverings and coatings compounded with a binding agent, more specially a synthetic resin binding agent, is made up of a front straight edge for leveling and a back straight edge for screeding, the two straight edges being joined together as a parallelogram having a driving system for moving them backwards and forwards lengthways. As part of the apparatus there is a track-laying vehicle and a system for vertical adjustment of the straight edges.

6 Claims, 8 Drawing Figures

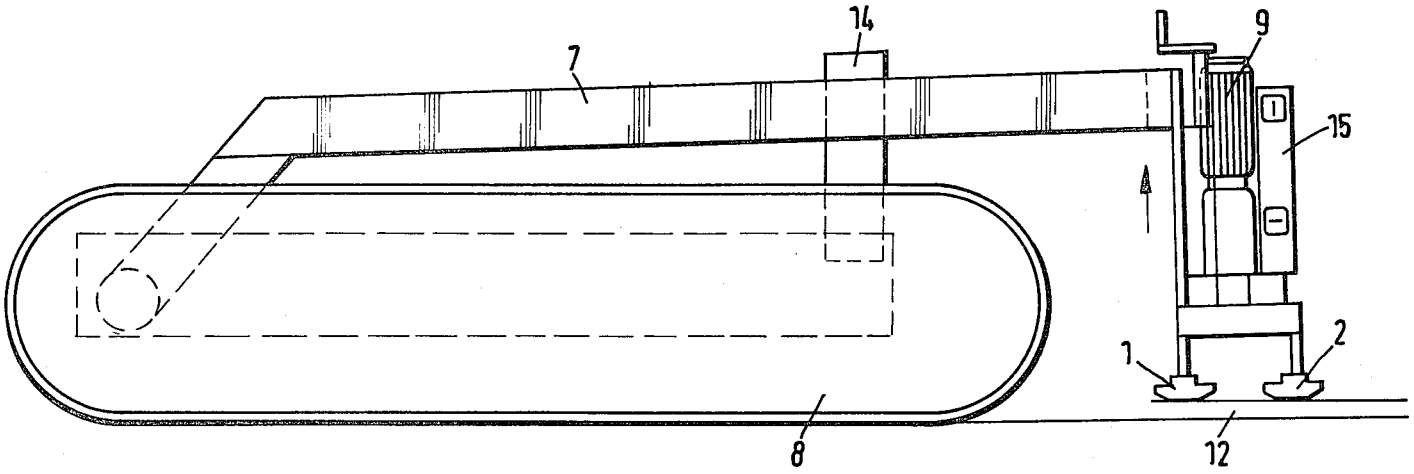
Fig. 3"

APPARATUS FOR SCREEDING AND LEVELING

BACKGROUND OF THE INVENTION

1. Field Of The Invention

The present invention relates to an apparatus for leveling and screeding materials compounded with binding agents, more specially synthetic resin binding agents.

2. Description Of The Prior Art

In the prior art one form of screeding apparatus was designed to be pulled by two persons and was made up of a front straight edge and, parallel thereto, a back straight edge, the two straight edges being joined together by a system of turnpins and links for forming a parallelogram so that the two straight edges might be moved backwards and forwards in their length directions in relation to each, the back straight edge being designed as a screeding straight edge or float. This earlier form of apparatus was only designed to be worked by hand, the links having grips at their ends so that they might be moved backwards and forwards. Furthermore, the prior art apparatus might not be used for truing up the thickness of a coating without the use of guides which had to be specially placed in position. Although the apparatus may have cut down the price of screeding so as to be lower than screeding by a normal screeding tool and may have been quicker, it was not possible for the apparatus to be powered.

BRIEF SUMMARY OF THE INVENTION

One purpose of the present invention is to provide a new design of a known apparatus for leveling and screeding so that it may be powered.

A further purpose of the present invention is to provide an adjustment system so that the apparatus may be used for leveling without the use of special guides fixed in the floor or the like.

A still further purpose of the invention is decreasing the amount of work necessary for operation of the apparatus.

A still further purpose of the invention, is to provide an apparatus designed so that a coating of concrete or the like may be produced with a regular thickness.

For effecting such purposes, and further purposes, in the invention the apparatus is joined up with a track-laying vehicle for moving it, and between the track-laying vehicle and the apparatus for leveling and screeding there is a connection system using threaded rods which make possible vertical adjustment of the screeding and leveling apparatus in relation to the track-laying vehicle, the leveling straight edge being positively guided while the screeding straight edge is floatingly supported. In a preferred form of the invention, the apparatus is characterized by a frame and a guide system joined up with the threaded rods by which the apparatus may undergo adjustment in a vertical direction in relation to the track-laying vehicle and, furthermore, at their lower ends, such threaded rods have parts free of threads in which they are taken up in other parts of the apparatus.

As a further part of the invention, the leveling straight edge has a high cross-rail, or blade, thereon for distribution of the material being leveled. As a further part of the invention, the screeding straight edge is placed at the lower ends of screws, each having a wing nut for adjustment of a helical spring and, for this reason, of the force acting on the screeding straight edge.

Because of the helical spring and the wing nut, the screeding straight edge is floatingly supported with a possible adjustment of the force acting thereon. Furthermore, at the two ends of the leveling straight edge, there are runners, joined with the said straight edge by screws placed in front of it and to the back of it, such runners at the ends of the leveling straight edge being designed for bridging over hollows in material being leveled and screeded.

In some cases it may be useful for the straight edges to be placed somewhat at an angle, this being done by using adjustable joints which make it possible for each straight edge to be separately put at an angle, although other systems may be used for such positioning of the straight edges, as for example a system using a turning frame so that the straight edges may be put at positive or negative angles.

The useful effect, from the engineering point of view, of the invention may firstly be seen in the new way of placing the straight edges (that is to say the positively guided leveling straight edge and the floating screeding straight edge) so that the coating to be processed is well compacted and smoothly screeded. These useful properties are furthermore produced by the fact that the part with the straight edges may be moved in an upright direction for adjustment in relation to the track-laying vehicle. A further useful effect is that, unlike the known apparatus, the angle of each straight edge may be changed and furthermore the two straight edges may be changed in angle at the same time so that the apparatus may be used for coatings up to 15 cm thick and different grain diameters of the aggregates used therewith. Such coverings are produced specially evenly and with a high quality if the covering thickness is less than 8 mm. Good distribution of the material may be produced by the cross-rail or blade on the front edge of the leveling straight edge, such cross-rail preventing material in front of the straight edge from being pushed thereover and it further makes certain that there is, at all times, enough material in front of the leveling straight edge. Furthermore, a highly useful effect is produced by the special way of supporting the screeding straight edge using a threaded rod or screw with a helical spring by which the force acting on the screeding straight edge may be changed for adjustment and for changing the floating supporting effect with respect to the screeding straight edge.

BRIEF DESCRIPTION OF THE DRAWINGS

A more detailed description will now be given of working examples of the invention with reference to the accompanying drawings wherein.

DETAILED DESCRIPTION

Figure 1:
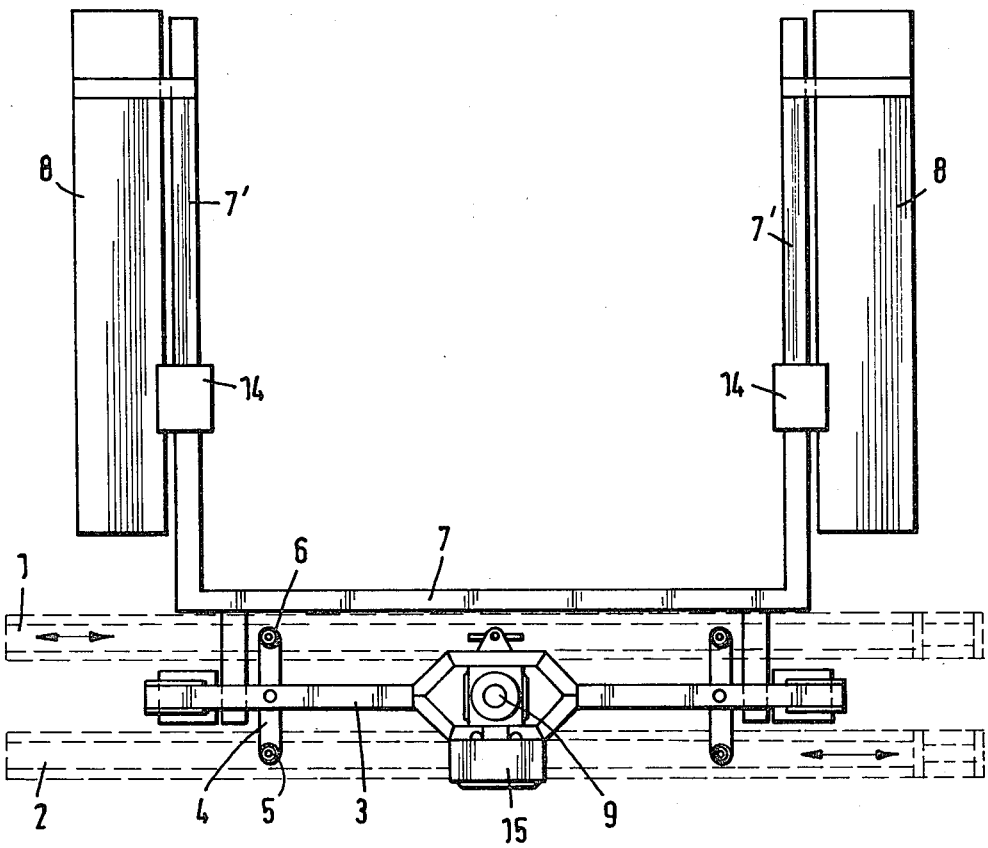
FIG. 1 is a schematic top plan view of the apparatus of the invention joined to a track-laying vehicle.

As will be seen in FIG. 1, a leveling straight edge is numbered 1 and a screeding straight edge is marked 2. Straight edges 1 and 2 are supported for by a cross-support 3 by way of links 4, rotatably joined with support bar 3 and having turnpins 5 and 6 at their ends for joining them with straight edges 1 and 2 so that turning motion of the links in relation to the straight edges 1 and 2 is made possible. The two-headed arrows to be seen in FIG. 1 are to make it clear that the straight edges may be moved backwards and forwards lengthways. Part of the apparatus with the straight edges is joined with a support frame 7, whose forwardly running shafts 7' are supported by track-laying units 8 of a track-laying vehicle. The way in which each shaft is joined with frame 7 will later be made clear in connection with FIG. 4 in more detail. There is furthermore a driving motor 9 and a box 15 with controls therefor. Straight edges 1 and 2 are marked in dash lines. The shafts 7' are guided by guides 14 on the two track-laying units.

Figure 2:
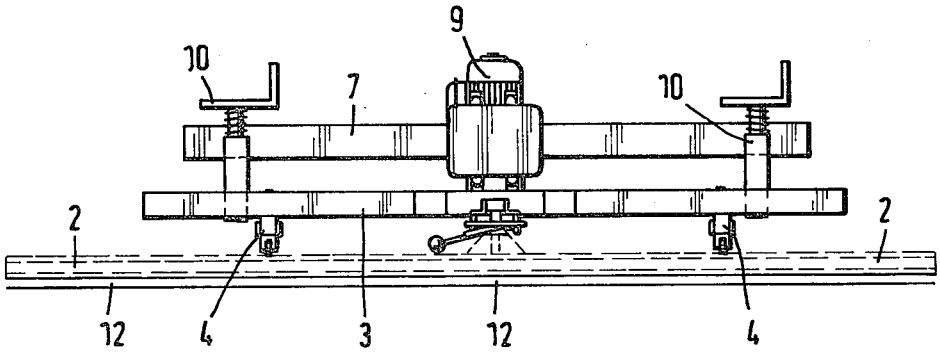
FIG. 2 is a schematic elevational view of the apparatus from the rear showing the position of the straight edges.

FIG. 2 is a view of the apparatus looking towards the straight edges and placed on a covering 12 which is to be leveled and screeded. It is possible to see the links 4 placed over and joined turningly with straight edges 1 and 2. Furthermore there is an adjustment system 10, of which more details will be given later in connection with FIG. 4.

Figure 3:
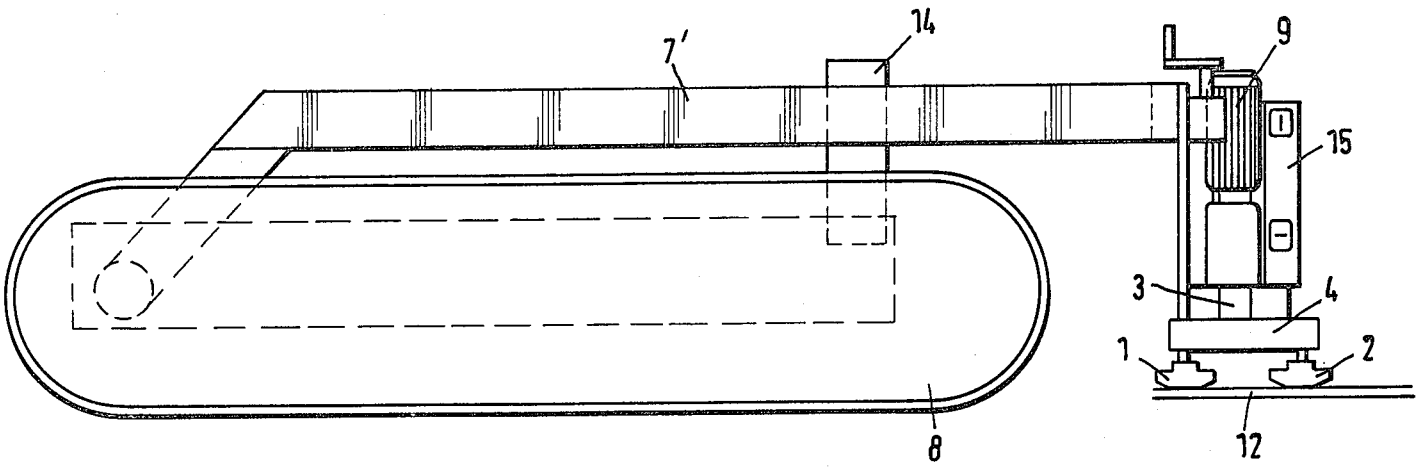
FIG. 3 is a schematic side elevational view of the apparatus with the straight edges in the normal running position, FIGS. 3' and 3'' are schematic side elevational views of the apparatus showing the straight edges at an angle such that the working faces of the straight edges are sloped uphill and downhill respectively.
Figure 3:
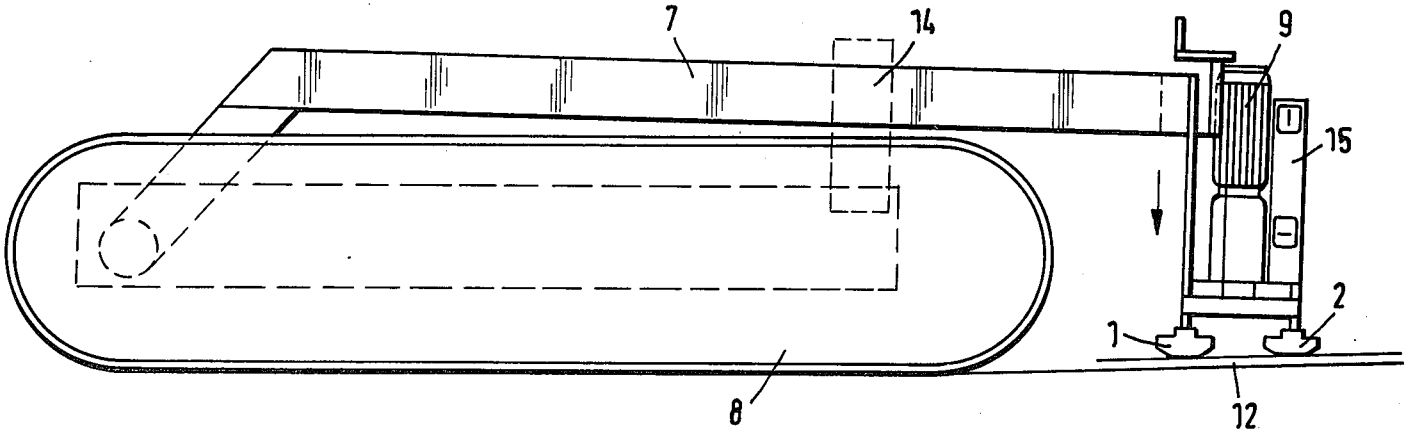

FIGS. 3, 3' and 3" are side views of the apparatus the frame 7 and the near-side track-laying unit 8, together with the driving motor 9 and the box 15 with controls. Straight edges 1 and 2 are seen in their normal position in FIG. 3 on covering 12 which is to be leveled and screeded. The frame 7 is guided, as noted, in a sideways direction in guides 14, such guides 14 furthermore being designed for lifting the forwardly running shafts of frame 7, although no details are given on this feature. In FIG. 3' frame 7 will be seen to have been lowered so that the straight edge part of the apparatus is put at an angle, that is to say with the front limits or edges of straight edges 1 and 2 somewhat higher up than the back limits or edges thereof. The opposite condition will be seen in FIG. 3", in which frame 7 has been lifted somewhat by guides 14, together with the part of the apparatus with the straight edges, whose back limits or edges are now somewhat higher up than the front limits or edges thereof. With this system, it is possible to move the straight edges into the true desired position thought to be necessary.

Figure 4:
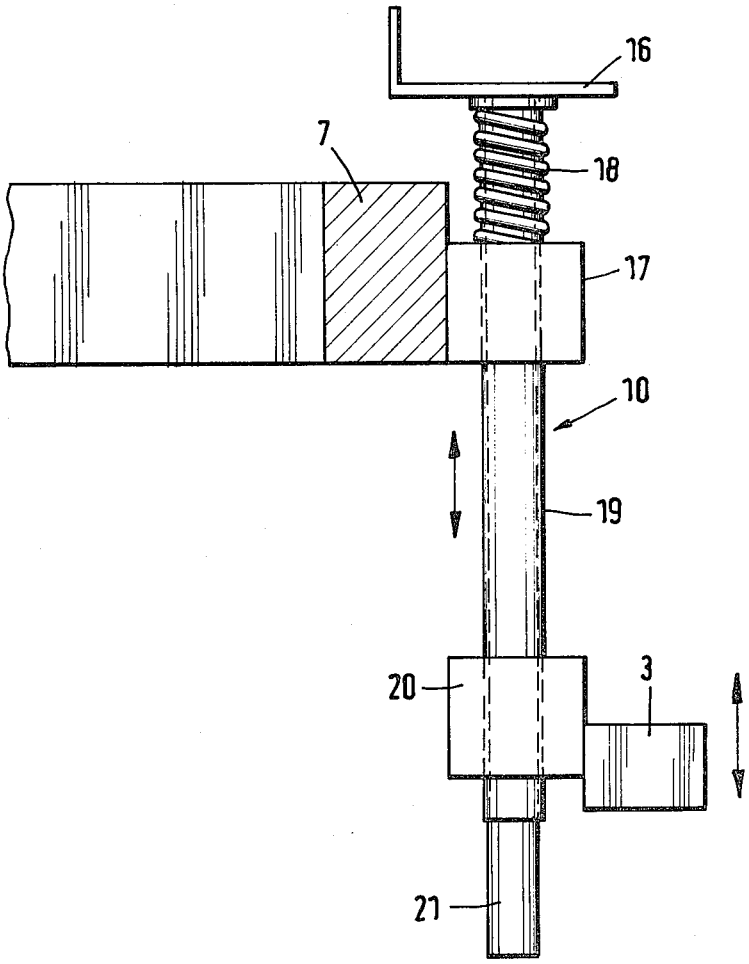
FIG. 4 is a diagrammatic elevational view of the adjustment system for adjusting the height of the apparatus with the straight edges in use and for lifting them clear of the ground, for example for transport.

FIG. 4 is a view of the part of the apparatus by which the unit with the straight edges is joined with frame 7, that is to say using the adjustment system 10 made up of a threaded rod 19 to be turned by a handwheel 16 at its top end. Between handwheel 16 and guide 17 there is a helical spring 18 for stopping undesired changes in position or undesired adjustment and for keeping the threaded rod in the position to which it has been turned. The threaded rod 19 is taken up in a headpiece 20 so that, by turning handwheel 16, the support bar 3 for the straight edges may be lifted and lowered. As may furthermore be seen from the figure, the lower part 21 of the threaded rod is free of thread. For readying the apparatus, handwheel 16 is turned so that the support 3 is moved so far down that free vertical motion on the rod 19 is possible, that is without motion of the straight edges being limited by the threaded portions of rods 19 the track-laying vehicle. The threaded rod 19 is joined with frame 7 by way of threaded eyepiece 17 or guide.

Figure 5:
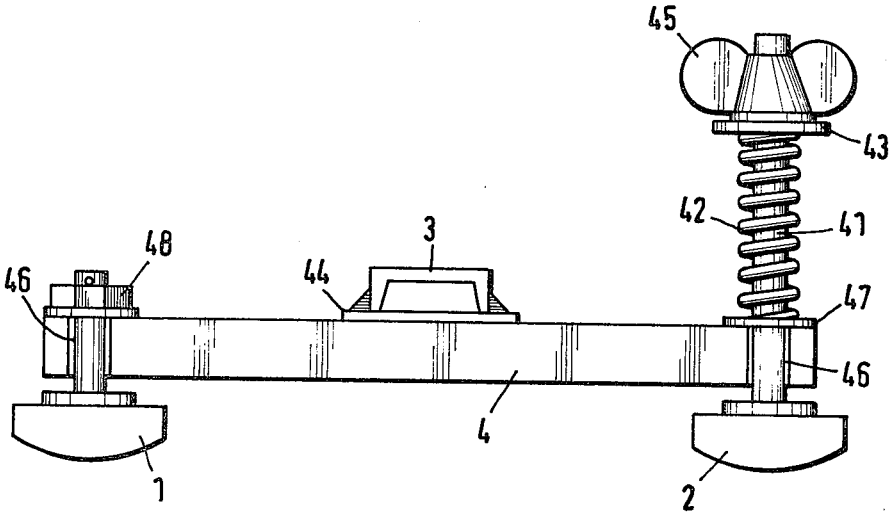
FIG. 5 is a side elevational view showing the screeding straight edge with a helical spring and a wing nut.

FIG. 5 is a diagrammatic view of the straight edges 1 and 2 on the links 4. It will be seen that the supporting stem 41 of screeding straight edge 2 goes up to a certain height past link 4 and has a helical spring 42 on it. At the top end of the screw or stem 41 there is a wing nut 45 for changing the force acting on the washer 43 and, for this reason, on the helical spring 42. By increasing the spring force, the force on the screeding straight edge 2 on the covering may be changed, the lower end of the spring resting against washer 47 on link 4 which is supported on support bar 3 which has a washer 44 welded thereon. If the force acting on the helical spring 42 is low, the screeding straight edge 2 will be rested with its full weight on the covering to be worked and screeded. If the force acting on the helical spring 42 is increased, the screeding force will be reduced. It has been noted on testing that, by increasing the screeding force, the liquid parts of the covering compound will be moved up to the upper face thereof, this increasing the strength of the covering (later) and stopping it from drying out. Because of the way the helical spring 42 is placed, straight edge 2 is floatingly supported. On the left hand side of the figure it will be seen that the leveling straight edge 1 is joined up with link 4 by way of a turnpin 46, whose top end has a nut 48 and a cotter-pin running therethrough. It is furthermore possible to have an adjustable joint in the supporting system for the straight edges under the link 4 so that each straight edge may be put at an angle separately for adjustment.

Figure 6:
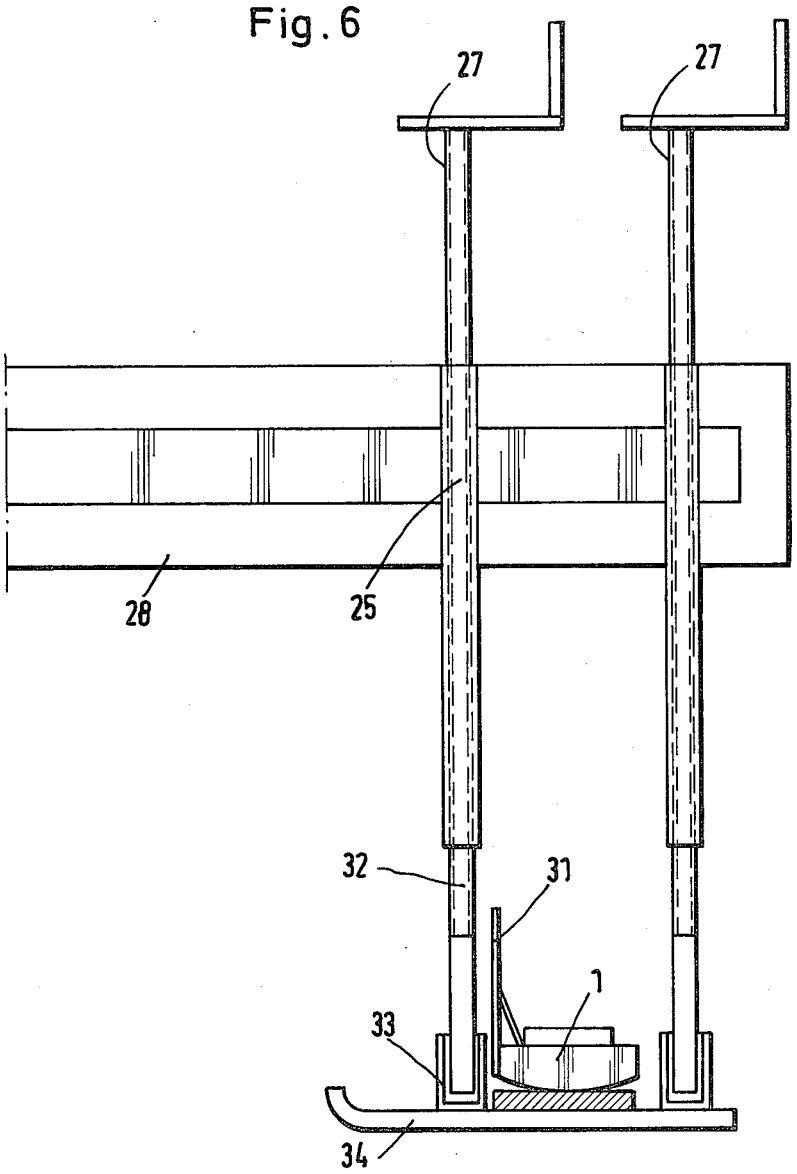
FIG. 6 is a diagrammatic elevational view of the two threaded rods acting with a runner.

FIG. 6 is a diagrammatic view of two threaded rods 27 disposed at each end of the leveling straight edge which are adjustably supported by frame 28 by engagement in threaded sleeves 25 mounted on the frame, such long sleeves preventing damage to the thread. The lower end 32 of each rod is, in this case, not safeguarded or covered over and engages in bearing members 33 on runner 34. This part of the system may be used when the covering to be leveled and screeded is somewhat uneven, runners 34 simply moving over holes in such covering. On the front side of straight edge 1 there is a blade 31 preventing any material from making its way over the straight edge and pushing along material in front of the straight edge 1 to get a good distribution of the material.

We claim:

1. In an apparatus for leveling and screeding a covering compounded with a binding agent, such as surfacing material for roads, having a front leveling straight edge and a screeding straight edge disposed in spaced relationship to the rear of said leveling straight edge, said straight edges being connected together by a system of link members and pivot pins to form a parallelogram, and a power driving system operably connected to at least one of said straight edges to selectively reciprocate said at least one straight edge in the direction of its length with respect to the other straight edge, the improvement comprising, a track-laying vehicle, a support frame supported on said track-laying vehicle, two threaded rods threadedly engaged in said support frame, means operatively engaging said straight edges with said threaded rods so that said straight edges are moved by said vehicle over the surface to be covered and are vertically movable in relation to said vehicle when said rods are rotated, a thread-free portion on the lower end of each rod freely slidably engageable with said straight edges, means to pivotably support said straight edges and means to support said screeding straight edge for vertical floating motion in use.

2. The apparatus as claimed in claim 1 wherein said means operatively engaging said straight edges with said rods comprises, a support bar extending substantially parallel to said straight edges, link members pivotally supported on said support bar, said straight edges being pivotally supported on said link members, and threaded members on said support bar threadedly engaging said threaded rods, and said means to support said screeding straight edge for floating motion comprises pivot rods extending substantially vertically and rotatably connected at their lower ends to said screeding straight edge, holes through said link members rotatably receiving said pivot rods, threaded upper ends on said pivot rods, threaded nuts on said threaded upper ends, and helical springs between said nuts and said screeding straight edge adapted to provide a resilient support for said screeding straight edge.

3. The apparatus as claimed in claim 1 and further comprising an upwardly extending blade mounted on the front of said leveling straight edge adapted to distribute material of said covering.

4. The apparatus as claimed in claim 2, wherein said nuts may be used for adjustment of the floating function of said screeding straight edge.

5. The apparatus as claimed in claim 1 and further comprising two threaded rods vertically adjustably mounted in the frame at each end of said leveling straight edge, one rod being in the front and the other rod being to the rear thereof, and a runner joined by said threaded rods with said leveling straight edge, so that said runner bridges over holes in the covering.

6. The apparatus as claimed in claim 1 wherein means are provided to adjust the angle of said frame about an axis normal to the direction of motion of said apparatus over said covering, so that the front edges of said straight edges are adjustable to be lower, or higher, than the back edges of said straight edges.

* * * * *